US006456690B2

(12) United States Patent
Yamada et al.

(10) Patent No.: US 6,456,690 B2
(45) Date of Patent: Sep. 24, 2002

(54) X-RAY GENERATOR, X-RAY INSPECTOR AND X-RAY GENERATION METHOD

(75) Inventors: Koichi Yamada, Chiba-ken; Takeshige Tanigaki, Tokyo, both of (JP)

(73) Assignee: mediXtec Japan Corporation, Chiba-ken (JP)

( * ) Notice: Subject to any disclaimer, the term of this patent is extended or adjusted under 35 U.S.C. 154(b) by 0 days.

(21) Appl. No.: 09/739,834

(22) Filed: Dec. 20, 2000

(30) Foreign Application Priority Data

Jun. 8, 2000 (JP) ..... 2000-171440

(51) Int. Cl.[7] ..... G21G 4/00
(52) U.S. Cl. ..... 378/119; 378/127; 378/137
(58) Field of Search ..... 378/119, 127, 378/137, 138

(56) References Cited

U.S. PATENT DOCUMENTS 4,047,044 A * 9/1977 Weaver ..... 378/98
4,631,742 A * 12/1986 Oliver ..... 378/113
4,827,494 A * 5/1989 Koenigsberg ..... 378/138
5,550,889 A * 8/1996 Gard et al. ..... 378/113
5,629,969 A 5/1997 Koshishiba ..... 378/138
5,682,412 A * 10/1997 Skillicorn et al. ..... 378/98.6
5,848,535 A * 12/1998 Sibik ..... 62/99
6,208,706 B1 * 3/2001 Campbell et al. ..... 378/9

FOREIGN PATENT DOCUMENTS

JP 7-260713 10/1995

OTHER PUBLICATIONS

English Language abstract of JP–7–260713.

* cited by examiner

*Primary Examiner*—Robert H. Kim
*Assistant Examiner*—George Wang
(74) *Attorney, Agent, or Firm*—Greenblum & Bernstein, P.L.C.

(57) ABSTRACT

An X-ray generator, an X-ray inspector and an X-ray generation method capable of automatically focusing an energy beam, such as an electron beam for generating an X-ray, on a target are provided. The generation, inspector and the method have been developed by turning an attention on the fact that convergence conditions of an electron beam has a close relationship with a temperature on a surface of an X-ray tube target. The method comprises the steps of measuring the temperature changes at real time by a temperature sensor 14 and automatically controlling a current value of a focusing coil 6.

7 Claims, 7 Drawing Sheets

X-RAY GENERATOR, X-RAY INSPECTOR AND X-RAY GENERATION METHOD

BACKGROUND OF THE INVENTION

1. Field of the Invention

The present invention relates to an X-ray generator, X-ray inspector and an X-ray generation method, more particularly relates to an innovative X-ray generator, X-ray inspector and an X-ray generation method having an automatic focusing function.

2. Description of the Related Art

X-ray generators are used for example as an X-ray generating source of an X-ray inspector. As an X-ray inspector, for example as shown in the Japanese Unexamined Patent Publication (kokai) No. 7-260713, there is known an X-ray inspector for emitting on a sample an X-ray of a minute focus size obtained by emitting a convergence electron beam to a target of a transmission type thin film and picking up by an X-ray image sensor an image of the transmission X-ray which is geometrically enlarged to be projected.

In the X-ray generator of the related art used in X-ray inspectors as above, focusing on a target of an electron beam is performed by manually adjusting a focusing coil every time a tube voltage is changed. Alternately, focusing is performed by storing an adjusted current value in advance and accessing the value.

However, since any of the above prior arts require human operation, there is a subject to be solved that it takes time for the preparation. Furthermore, an accuracy of focusing adjustment of the electron beam on the target is largely affected by individual differences of operators so that stable focusing cannot be always obtained.

SUMMARY OF THE INVENTION

An object of the present invention is to provide an X-ray generator, an X-ray inspector and an X-ray generation method capable of automatically focusing an energy beam of for example an electron beam for generating an X-ray on a target.

The present invention relates to a general new technology for providing an automatic focusing function to an X-ray generator. The present inventors have turned their attention to the fact that there is a close relationship between convergence conditions of an energy beam, such as an electron beam, and a surface temperature of the X-ray tube target, and have discovered that the above object is attained by measuring the temperature changes at real time and making the current value of the focusing coil be automatically controlled, as a result the present invention has been completed. The present invention can provide an epoch-making innovative technique to development and production of an X-ray tube of the next generation.

Namely, an X-ray generator according to the present invention comprises:

an energy beam generation source;

a target for generating an X-ray by being irradiated an energy beam generated from said energy beam generation source;

a convergence lens for converging the energy beam proceeding to said target from said energy beam generation source;

a temperature sensor for detecting a temperature near an irradiation point of said energy beam on said target; and a control device for controlling a convergence degree of said energy beam on the target by means of said convergence lens based on a temperature signal detected by said temperature sensor.

The energy beam generation source is for example an electron beam generation source. The target is not particularly limited, but comprised, for example, of a tungsten layer and a beryllium layer. The target is not particularly limited and may be a transmission type target or reflection type target.

The transmission type target is irradiated an energy beam on the target surface and emits an X-ray from its back side. The specific configuration of the transmission type target is not particularly limited, but a thin beryllium (Be) metal substrate (a beryllium layer) having good X-ray transmittancy, on which a thin film of tungsten (W) (a tungsten layer) is formed, may be mentioned as an example. The reflection type target is irradiated an energy beam on the target surface and emits an X-ray from its emission surface. As the reflection type target, a target substrate made by copper, on which a tungsten metal layer is formed, may be mentioned as an example.

The convergence lens is for example a focusing coil.

It is preferable that the control device controls a current value to be given to said focusing coil based on time differentiation of the temperature detected by said temperature sensor.

It is preferable that said target comprises a first metal layer having a predetermined pattern and a second metal layer having a predetermined pattern connected to the first metal layer through a hot contact point formed in an insulation layer, and a thermocouple type temperature sensor comprised of the first metal layer and second metal layer is made to be one body within the target.

Note that the temperature sensor is not particularly limited in the present invention and may be a contact type temperature sensor or non-contact type temperature sensor.

As the contact type temperature sensor, so-called thermocouple to which the Seebeck effect is applied may be mentioned as an example. It is preferable that a contact point for measuring temperature of the thermocouple is arranged contacting near a focal point on the target surface. The temperature of the object differs depending on the contacting position of the contact point for measuring temperature, but an R-type (platinum-platinum, rhodium-base) thermocouple is preferable able to be used even in a high temperature range in order to be applied to a wide range of a tube voltage. Also, the contact point of strands composing the thermocouple may be an insulation type or an exposure type, but ones having a contact point structure of a shape and size of small thermal capacity which does not disturb the original absolute value of the temperature are preferable.

As the non-contact type temperature sensor, so called an infrared irradiation thermometer which converges by a lens an infrared ray (a wavelength range of 0.8 to 1000 $\mu$m) emitted from a temperature measured object and detects at a thermopile hot contact point may be mentioned.

An x-ray inspector according to the present invention comprises the X-ray generator explained above and an X-ray image sensor having an X-ray detection surface for detecting an image of an X-ray transmission light irradiated on an object to be inspected from said X-ray generation portion; which detects an image by enlarging the core portion of said object to be inspected at an enlarging magnification determined based on a positional relationship of said X-ray generation portion and the object to be inspected.

An X-ray generation method according to the present invention comprising the steps of detecting a temperature near an irradiation point of an energy beam on a target; and generating an X-ray by irradiating said energy beam on the target while controlling a convergence degree of said energy beam on the target by means of a convergence lens based on a signal detected by the step of detecting the temperature.

Generally, when an energy beam (electron beam) having a high energy collides with a solid substance (target), most of the energy is converted to heat energy and only a little portion of the energy contributes to generation of an X-ray. At this time, it is accompanied by temperature raise of the target material itself, and an irradiated portion on the target becomes a low temperature or a high temperature depending on the convergence degree of the energy beam, that is, a size of a diameter of the focal point. The characteristics can be applied to the invention by measuring a target temperature (T) at a real time, searching the peak temperature (Tp), and controlling a current in the convergence lens (a convergence coil or a focusing coil), as a result, the focus can be optimally adjusted.

BRIEF DESCRIPTION OF THE DRAWINGS

These and other objects and features of the present invention will become clearer from the following description of the preferred embodiments given with reference to the accompanying drawings, in which.

DESCRIPTION OF THE PREFERRED EMBODIMENTS

First Embodiment

Figure 1:
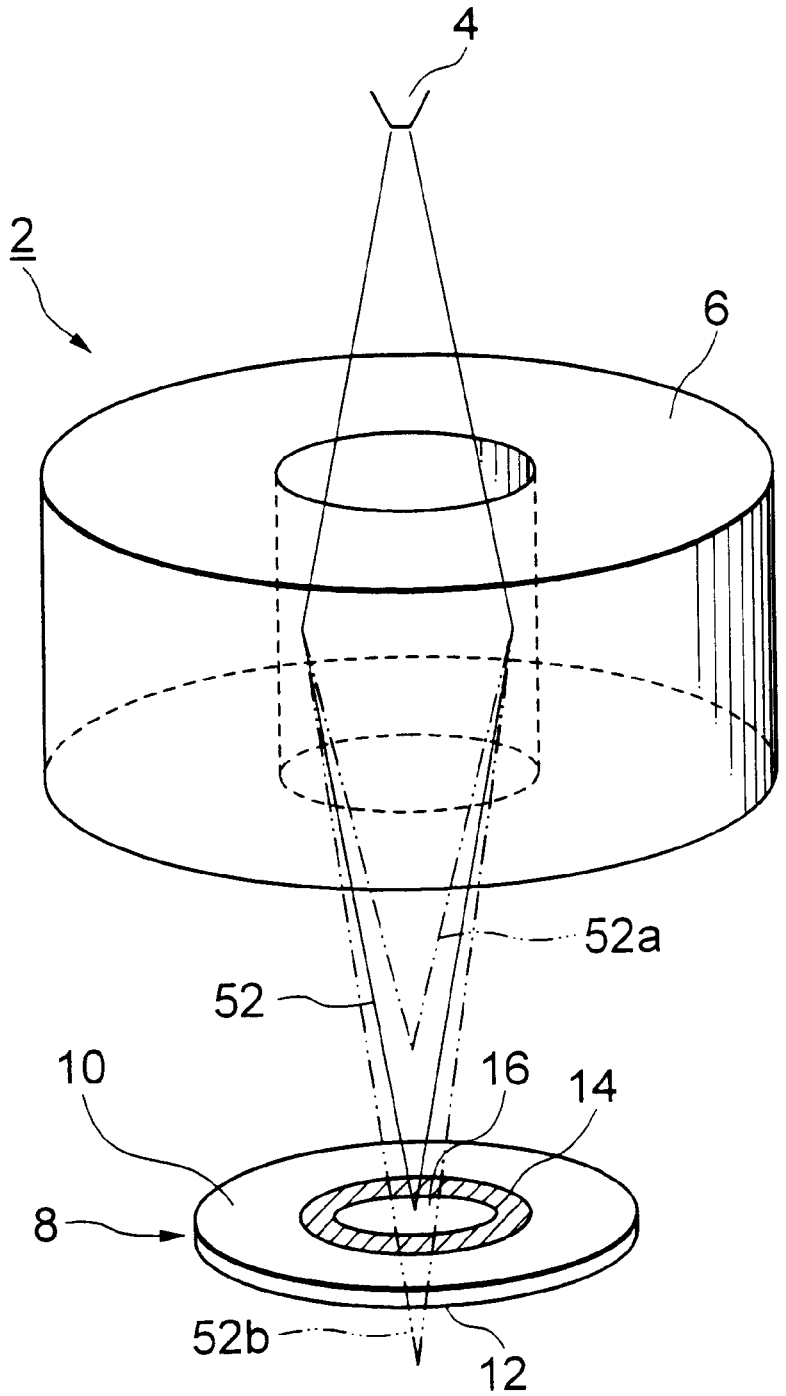
FIG. 1 is a view of a principle of an X-ray generator according to an embodiment of the present invention.

As shown in FIG. 1, an X-ray generator 2 according to the first embodiment of the present invention comprises a cathode 4 as an energy beam generating source, a target 8 for generating an x-ray by being irradiated an electron beam 52 generated by the cathode 4, and a focusing coil as a convergence lens for converging the electron beam 52 proceeding to a target 8.

The cathode 4 is comprised of a hairpin-shaped filament and is made to be able to generate an electron beam by applying a voltage. The focusing coil 6 is for converging the electron beam passing through its center portion to a surface of the target 8. When a current to be applied to the focusing coil 6 is too large, the electron beam is focused before the surface of the target 8 (the reference number 52*a* in FIG. 1), while when the current is too small, it is focused over the target 8 (the reference number 52*b* in FIG. 1).

The target 8 is obtained by forming a thin film of a tungsten (W) (tungsten layer 10) on a beryllium (Be) metal substrate (beryllium layer 12) having a good X-ray transmittancy. A shape of the target 8 is not particularly limited but is a disk shape in the present embodiment. As a result that a focal point 16 of the electron beam 52 comes on the approximate center of a surface of the tungsten layer 10, an X-ray is emitted from the beryllium layer 12 side.

Near the surface of the target 8 is arranged a temperature sensor 14 as close to the focal point of the target as possible, and a temperature near the focal point on the target 8 can be detected.

When the electron beam hits the surface of the target 8, the respective electrons repeatedly collide with the respective atoms and penetrates from the target surface to inside the target, and stop the movement at a certain depth due to a loss of the whole energy. The depth of the penetration depends on an accelerating energy of the electron beam. It may be considered that the closer to the surface of the target material the larger the heating amount is, the most appropriate condition to give to the focusing coil can be searched at a moment by detecting the temperature changes over time (dT/dt) near the surface due to the whole heat radiant amount generated by moving from the surface to inside. In this case, an abrupt temperature inclination from the center of the focal point to the neighborhood further to distant is formed due to accompanied heat conduction and heat radiation phenomenon. Accordingly, the position for providing the temperature sensor 14 is preferably as close as possible to the focal point on which the electron beam is irradiated.

Figure 3:
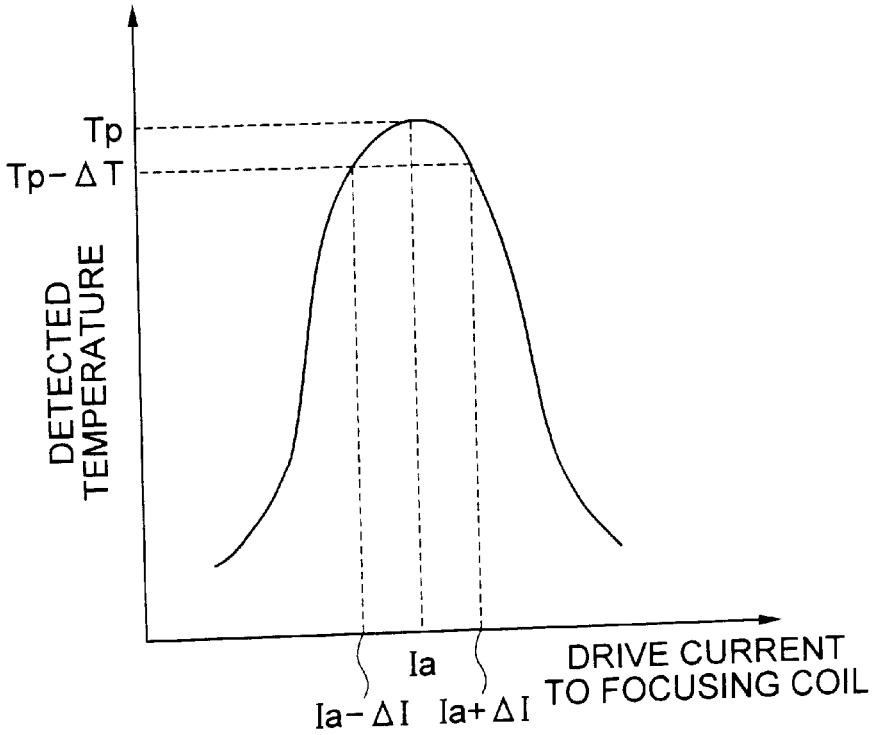
FIG. 3 is a graph of an example of a relationship between a detected temperature and a current of a focusing coil.

The relationship of the temperature detected by the temperature sensor 14 and a drive current to the focusing coil 6 is shown in FIG. 3. When the drive current value for the focusing coil is low, the electron beam comes in focus at a position over the target 8 as shown in the reference number 52*b* in FIG. 1. Thus, the electron beam is irradiated in a defocused condition on the target 8 and the detected temperature by the temperature sensor 14 is low. While, when the drive current value for the focusing coil is too high, the electron beam comes in focus before the target as indicated by the reference number 52*a* in FIG. 1, thus, the electron beam is also irradiated in a defocused condition on the target 8 and the temperature detected by the temperature sensor 14 becomes low. Therefore, as shown in FIG. 3, by searching the peak temperature Tp of the detected temperature, the most appropriate drive current value Ip for the focusing coil 6 can be selected. It can be expected that the electron beam is irradiated in just focus on the target at the time when the drive current is Ia and the diameter of the focal point on the target surface becomes minimum.

For "automatic adjustment of a diameter of a focal point", it is important to perceive the temperature change accurately with high sensitivity (high speed response) and to search conditions under which the change of temperature over time dT/dt becomes close to "0"(conditions to obtain the maximum value Tp) than to accurately measuring the absolute value of the temperature itself.

Figure 2:
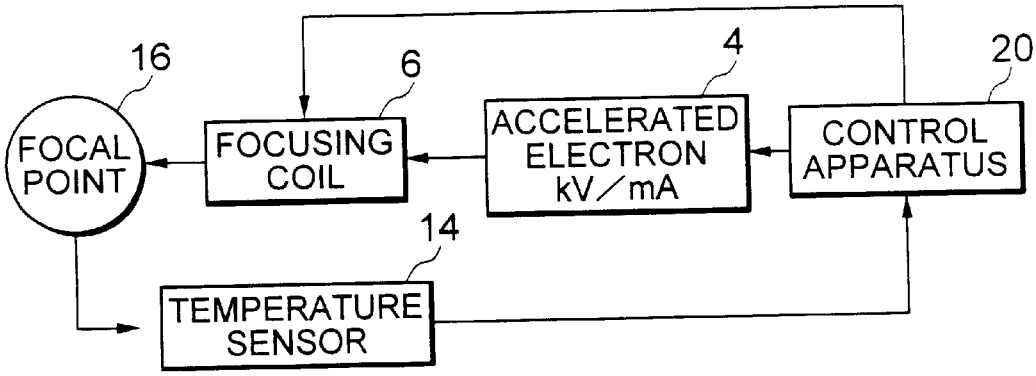
FIG. 2 is a block diagram of an automatic focusing device in the X-ray generator according to the embodiment of the present invention.

Specifically, as shown in FIG. 2, the temperature near the focal point 16 is detected by the temperature sensor 14, the temperature change over time dT/dt is calculated by the control apparatus 20 and the cathode 4 and the focusing coil 6 are brought under feedback control so that the dT/dt comes close to "0".

Note that when the electron beam having a high energy is converged and irradiated on a minute area of the target surface, it is partially strongly heated and results in rising the temperature (electron beam irradiation damage). As a result, it is liable that the target itself having a two layered structure is softened, deformed or formed a pin-hole. Melting points of tungsten (W) and beryllium (Be) are respectively 3,387° C. and 1,278° C., and thus, it can be considered that the damages are mainly caused by softening and melting of beryllium having a low melting point.

In terms of reducing the electron beam irradiation damages, the electron beam may be made irradiate at the position a little deviated from the position to bring the maximum value Tp of the detected temperature on the surface of the target 8. Namely, the control apparatus 20 shown in FIG. 2 may control the drive current to the focusing coil 6 so as to satisfy $Tp-\Delta T$, that is, $Ia\pm\Delta I$. In terms of reducing the power consumption, it is preferable to perform feedback controlling by the control apparatus 20 aiming $Ia-\Delta I$ as a target. Note that the $\Delta T$ and $\Delta I$ are constants of 0 or more determined by experiments, etc.

Figure 4:
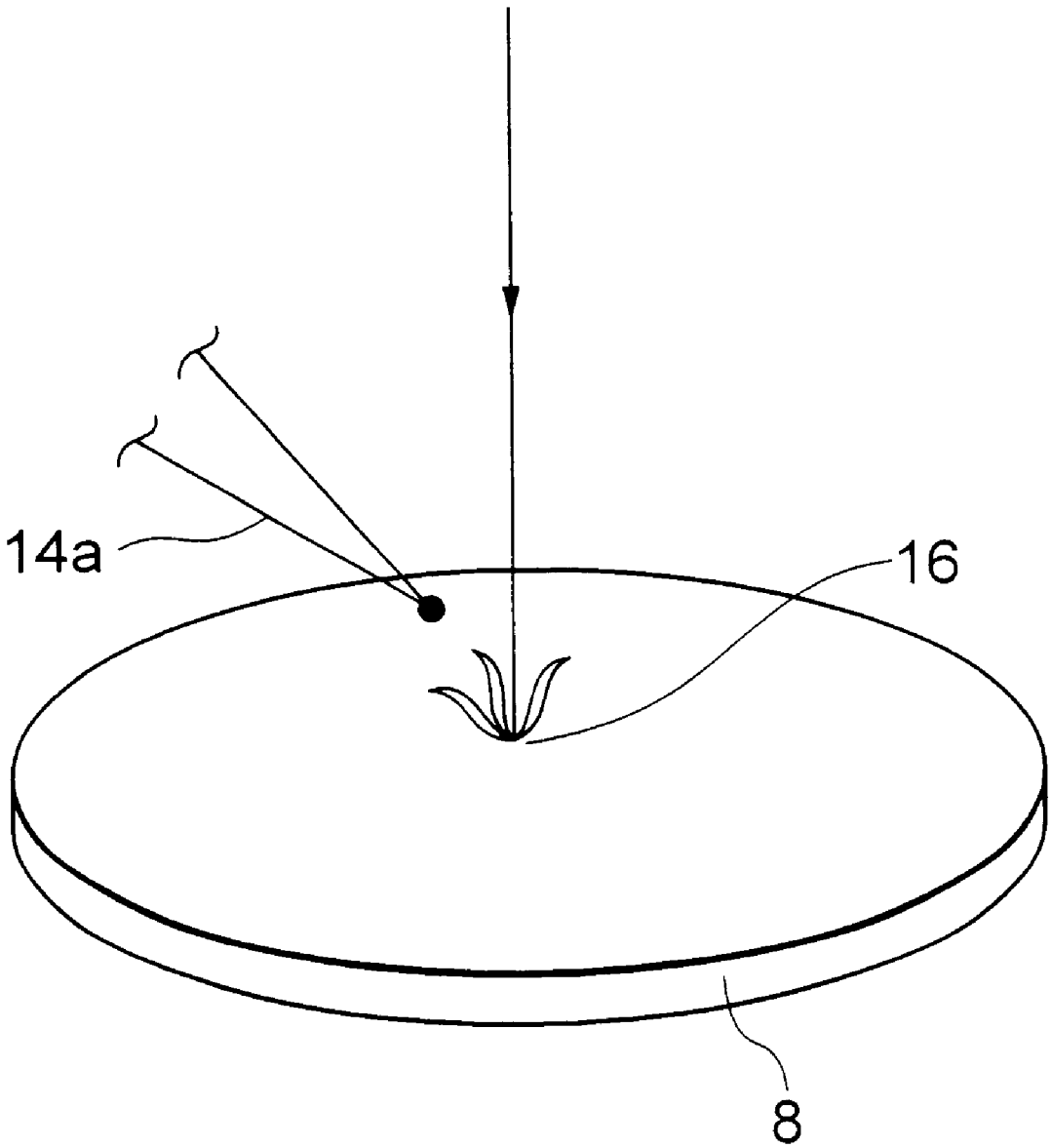
FIG. 4 is a schematic view of an example of measuring an temperature of a target by a contact sensor.

As shown in FIG. 4, a thermocouple 14*a* which is an application of the Seebeck effect is used as the temperature sensor 14 in the present embodiment. The temperature of an object differs depending on contact positions. An R-type (platinum-platinum, rhodium-base) thermocouple is preferable, because it is able to be used even in a high temperature range, which means that it is able to be used within a wide range of a tube voltage. Also, the contact point of the strands may be an insulation type or an exposure type as far as it has a contact point structure of a shape and size of small heat capacity which does not disturb the original absolute value of the temperature. The contact point of measuring the temperature of the thermocouple 14*a* is arranged contacting near the focal point on the target surface.

Second Embodiment

Figure 5A:
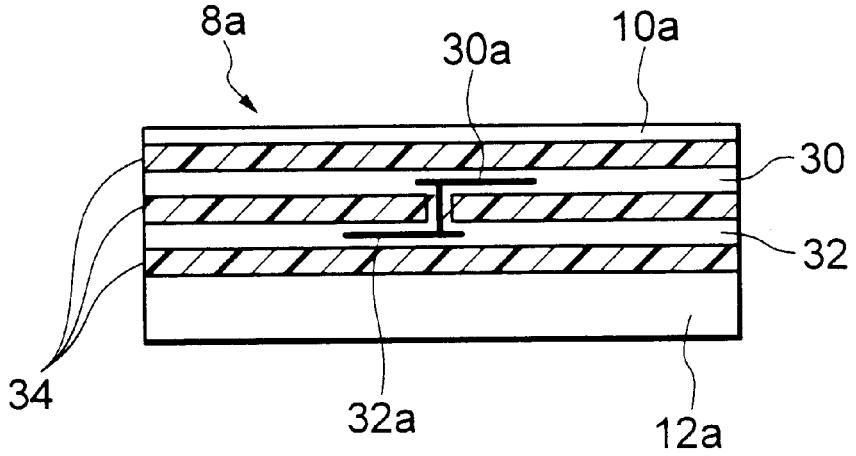
FIGS. 5A and 5B are schematic views of another example of measuring an temperature of a target by a contact sensor.
Figure 5B:
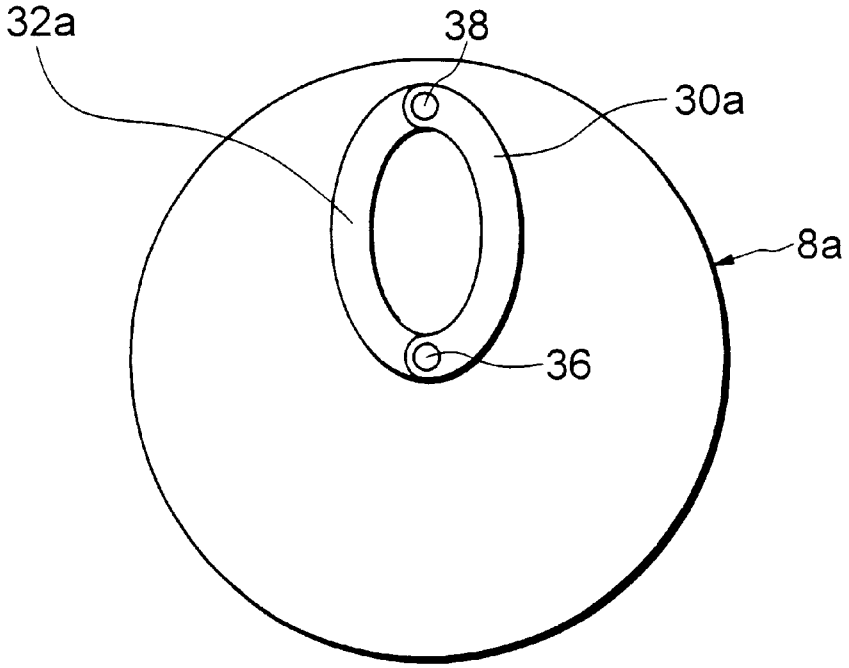

As shown in FIGS. 5A and 5B, the present embodiment is the same as the above first embodiment excepting that the temperature sensor is made to be one body inside the target 8a.

The target 8*a* of the present embodiment comprises a tungsten layer 10*a*, a first metal pattern layer 30, a second metal pattern layer 32, a beryllium layer 12*a*and insulation layers 34 positioned between these layers. The target 8*a* can be formed to have an interlayer of five-layer structure by applying a semiconductor lithography technique to a normal transmission type X-ray tube target of a two-layer structure. Namely, the target 8*a* has a structure of seven layers in total, a W layer 10*a*, insulation layer 34, first metal layer 30, insulation layer 34, second metal pattern layer 32, insulation layer 34 and Be layer 12*a*.

The first metal pattern layer 30 and the second metal pattern layer 32 are formed in any line patterns 30*a* and 32*a* composing the thermocouple, which are connected at a hot contact point 36 and a cold contact point 38 buried in contact holes formed on the insulation layer 34 arranged between them. The hot contact point 36 is formed at a position immediately below the focal point of the electron beam.

The first metal pattern layer 30 and the second metal pattern layer 32 are comprised of mutually different metals and forms a thermocouple as a temperature sensor by connecting these patterns via the contact points 36 and 38.

Materials and layer thicknesses of the respective insulation layers 34 are not particularly limited as far as they satisfy the condition that their upper and lower layers can be electrically completely insulated. The respective insulation layers 34 are comprised for example of a silicone oxide film ($SiO_2$), silicon nitride film ($Si_3N_4$), etc. often used in a semiconductor producing process and the films can be formed by a physical vapor deposition (PVD) or the chemical vapor deposition (CVD).

To form a connection point of the two kinds of metal pattern layers, the first metal pattern layer 30 and the second metal pattern layer 32, that is, the contact points of temperature measurement (hot contact points 36 and cold contact points 38), and to form a connection point between the hot contact points 36 and the tungsten layer 10*a*, it is sufficient to form contact holes between the two layers by the mask/window-opening technique and to obtain electric conductivity at the time of forming an upper layer.

Here, the hot contact point 36 is arranged near the center of the target on which the electron beam focuses, while the cold contact point 38 is arranged at a peripheral portion of the target 8*a*. Note that the cold contact point 38 may be provided with lead lines from the first metal layer 30 and the second metal layer 32, respectively, and arranged outside of the target 8*a*. The most surface layer of the tungsten layer 10*a* is preferably subjected to flattening processing in accordance with needs considering a surface shape condition affecting an X-ray generation efficiency.

In the present embodiment, since the temperature sensor is made inside the target 8*a* as one body, it is not necessary to provide a temperature sensor separately and the configuration of the X-ray generator can be simplified.

Third Embodiment

Figure 6:
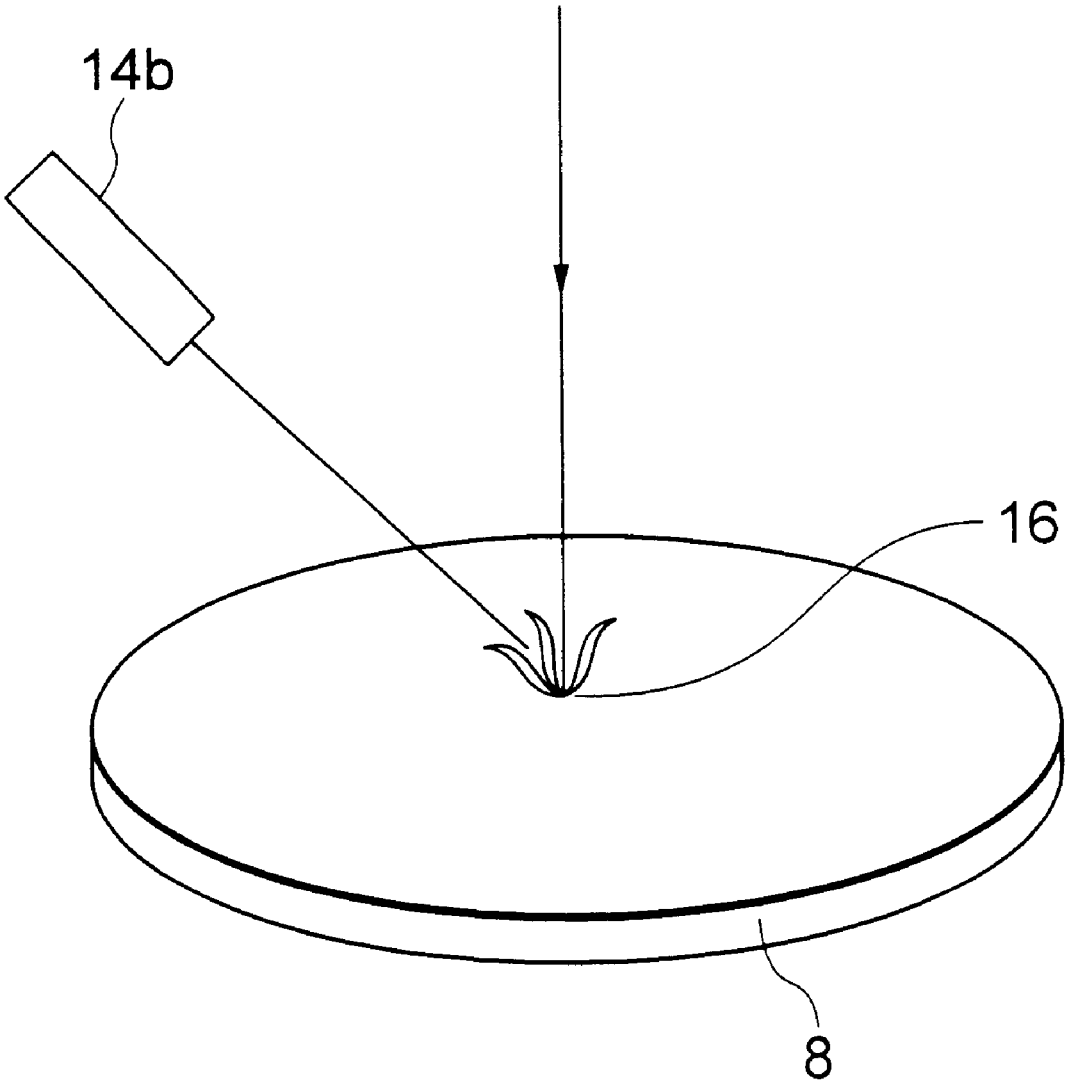
FIG. 6 is a schematic view of an example of measuring an temperature of a target by a non-contact sensor.

As shown in FIG. 6, the present embodiment is the same as the above first embodiment excepting that a non-contact type so-called an infrared irradiation thermometer 14*b* is used as the temperature sensor.

The thermometer 14*b* of the present embodiment is so called an infrared irradiation thermometer which converges by a lens an infrared ray (a wavelength range of 0.8 to 1000 $\mu$m) emitted from a target 8 as an object of temperature measurement and detects at a thermopile hot contact point. Considering all external disturbance factors (a light, an atmosphere gas flow, dusts, etc.), the thermometer 14*b* is preferably as close as possible to a minute surface area receiving the electron beam irradiation.

However, since the method of detecting the temperature by using the infrared irradiation thermometer 14*b* has little restrictions on distances, it can be freely arranged if only a straight path is secured. In the method of using this thermometer, an infrared ray emitted from the target surface has to be caught for any targets of reflection type and transmission type. Accordingly, it is necessary that the temperature sensor 14*b* is built-in at the most suitable position inside an X-ray tube generator in a production stage of the X-ray generator.

Fourth Embodiment

Figure 7:
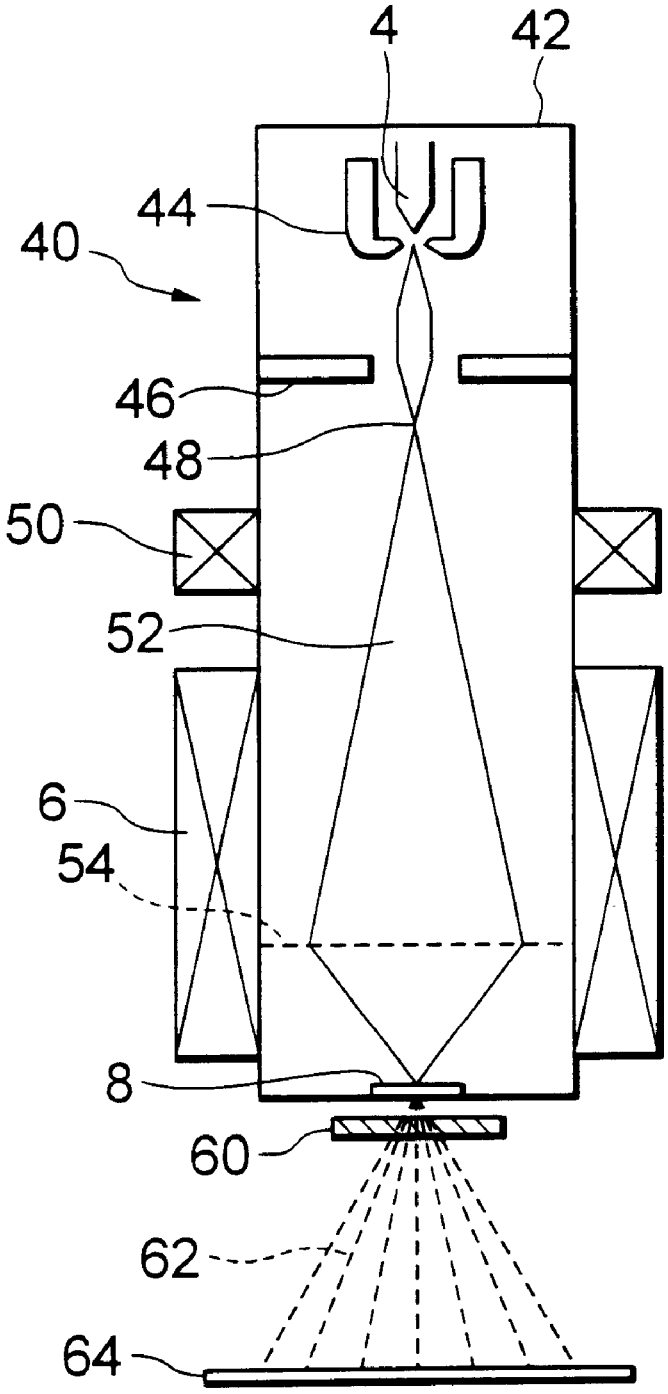
FIG. 7 is a schematic view of the X-ray inspector according to an embodiment of the present invention(transmission type target)

An X-ray inspector 40 according to the present embodiment shown in FIG. 7 includes the X-ray generator explained in any of the above embodiments in terms of the principle, and is capable of obtaining an X-ray transmission enlarged image of an object 60 to be inspected.

The X-ray inspector 40 of the present embodiment comprises a cathode 4 for generating an electron beam, a grid 44 for drawing out the electron beam, an anode 46 for accelerating the electron beam, an alignment coil 50 for adjusting the electron beam, a focusing coil 6 for converging the electron beam 52, and a target 8 generating an X-ray 62 by being irradiated the converged electron beam. Note that in FIG. 7, the reference number 48 indicates a virtual focal point position and the reference number 54 indicates a magnetic gap. Inside the casing 42 is a path of the electron beam which is sealed and kept vacuum by a not shown vacuum pump., etc.

The target 8 is a transmission type target, which is irradiated a converged electron beam on the surface of the target 8 and generates an X-ray 62 in a conical shape having a predetermined angle of spreading from a substantially dotted X-ray generating portion on the back side of the target corresponding to the focal point position.

The X-ray 62 having a predetermined expanding angle emitted from the back side of the target 4 irradiates the object 60 to be inspected and its enlarged transmission image is irradiated on an X-ray detection surface 64 of an image amplifier in an X-ray image sensor. The image intensifier is an apparatus for converting the x-ray to a visible light, amplifying the luminance of the enlarged X-ray transmission image which passed through the object 60 to be inspected and reproducing an image having higher luminance. A transmission image having a high luminance amplified by the image amplifier is captured by an image pickup device, such as a charge-coupled device (CCD) camera, image pickup tube, and displayed on a monitor. The transmission image data picked up by the image pickup device is not only displayed on the monitor but can be output to a printer, etc., furthermore, stored in a memory means, such as a semiconductor memory, hard disk, magneto-optical memory device. Moreover, the transmission image data can be transmitted to other devices via an exclusive cable or a public line.

Note that the geometrical magnification "M" of the transmission image of the object 60 to be inspected detected by the X-ray detection surface 64 of the image amplifier is defined by the ratio of an FDD distance from the X-ray generation portion of the target 8 to the center of the X-ray detection surface 64 and an FOD distance from the X-ray generation portion to the object 60 to be inspected. Namely, the geometrical magnification M=FDD/FOD.

The object 60 to be inspected is not particularly limited and, for example, an IC device and other devices, and devices having a package of an area array type represented by the ball grid array (BGA) and the chip size package (CSP).

Fifth Embodiment

Figure 8:
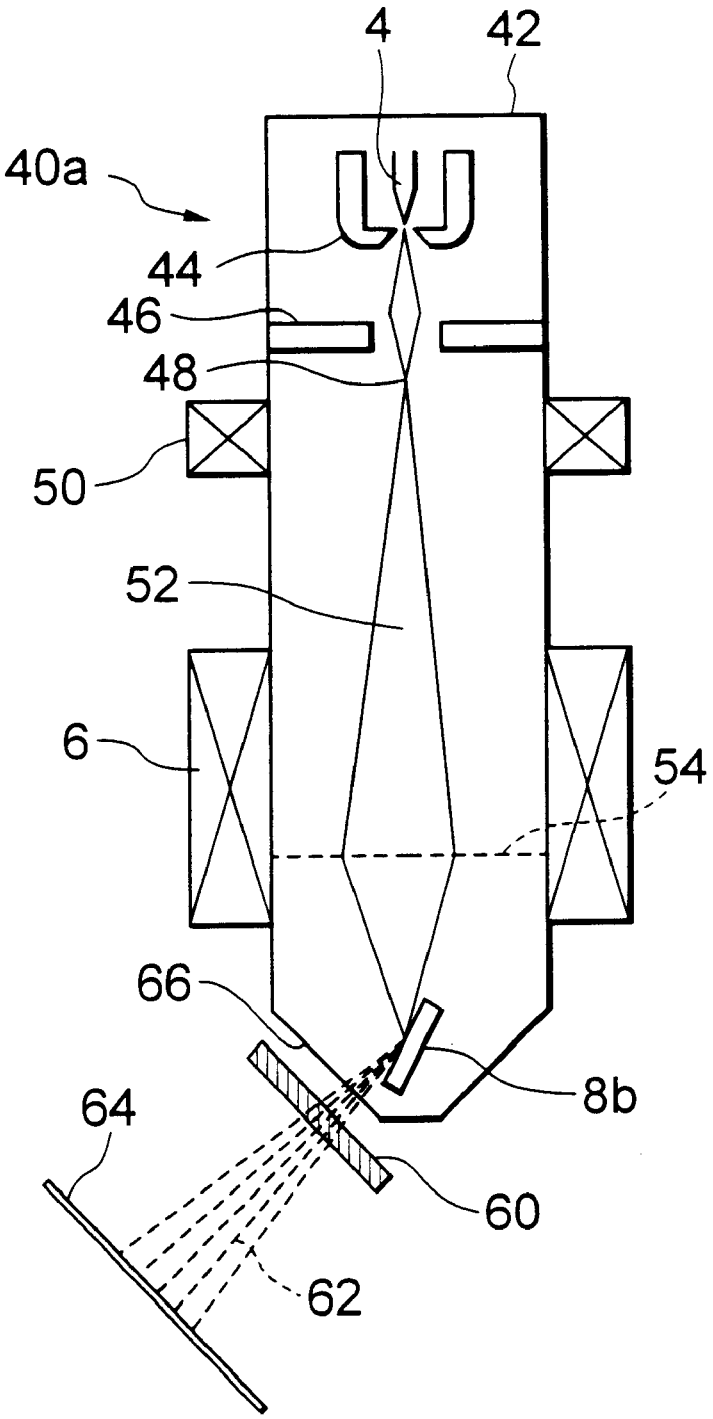
FIG. 8 is a schematic view of an X-ray inspector according to another embodiment of the present invention (reflection type target).

An X-ray inspector 40*a* according to the present embodiment shown in FIG. 8 has the X-ray generator explained in any of the above embodiments in terms of the principle, and is capable of obtaining an X-ray transmission enlarged image of the object 60 to be inspected. In this point, the X-ray inspector 40*a* of the present embodiment is the same as the X-ray inspector 40 of the above fourth embodiment, but different only in the point that not a transmission type but a reflection type X-ray generator is provided. Below, only the different point will be explained.

The X-ray inspector 40*a* of the present embodiment comprises a target 8*b* inside a casing 42. The target 8*b* generates an X-ray 62 in a reflecting direction by being irradiated a converged electron beam 52. Note that the reference number 66 indicates an X-ray tube head of a type having an inclination degree of 45 in FIG. 8.

Note that the present invention is not limited to the above embodiments and includes modifications within the scope of the claims.

For example, the specific configurations of the X-ray generator and X-ray inspector are not limited to the above embodiments and a variety of types of X-ray generators and X-ray inspectors can be used.

As explained above, according to the present invention, an X-ray generator, X-ray inspector and an X-ray generation method capable of automatically focusing an energy beam, such as an electron beam for generating an X-ray, on a target can be provided.

What is claimed is:

1. An X-ray generator comprising:

an energy beam generation source;

a target for generating an X-ray by being irradiated by an energy beam generated from said energy beam generation source, said target comprising a first metal layer having a predetermined pattern and a second metal layer having a predetermined pattern connected to said first metal layer through a hot contact point formed in an insulation layer, said target further comprising an integrally-formed thermocouple temperature sensor within said first metal layer and said second metal layer;

a convergence lens for converging the energy beam proceeding to said target from said energy beam generation source;

a temperature sensor for detecting a temperature near irradiation of said energy beam on said target; and a control device for controlling a convergence degree of said energy beam on the target by use of said convergence lens, based on a temperature signal detected by said temperature sensor.

2. The X-ray generator as set forth in claim 1, wherein said energy beam generation source is an electron beam generation source.

3. The X-ray generator as set forth in claim 1, wherein said target comprises a tungsten layer and a beryllium layer.

4. The X-ray generator as set forth in claim 1, wherein said convergence lens is a focusing coil.

5. The X-ray generator as set forth in claim 1, wherein said control device controls a current value to be given to said focusing coil based on time differentiation of the temperature detected by said temperature sensor.

6. An X-ray inspector, comprising an X-ray generator including an X-ray generation portion for generating an X-ray, and an X-ray image sensor having an X-ray detection surface for detecting an image of an X-ray transmission light irradiated on an object to be inspected from said X-ray generation portion; which detects an image by enlarging the core portion of said object to be inspected at an enlarging magnification determined based on a positional relationship of said X-ray generation portion and the object to be inspected; wherein:

said X-ray generator comprises:

an energy beam generation source, a target for generating an X-ray by being irradiated by an energy beam generated from said energy beam generation source, said target comprising a first metal layer having a predetermined pattern and a second metal layer having a predetermined pattern connected to said first metal layer through a hot contact point formed in an insulation layer, said target further comprising, an integrally-formed thermocouple temperature sensor within said first metal layer and said second metal layer, a convergence lens for converging the energy beam passing to said target from said energy beam generation source, a temperature sensor for detecting a temperature near an irradiation point of said energy beam on said target, and a control device for controlling a convergence degree of said energy beam on the target by use of said convergence lens, based on a temperature signal detected by said temperature sensor.

7. An X-ray generation method comprising:

detecting a temperature near an irradiation point of an energy beam on a target, the target comprising a first metal layer having a predetermined pattern and a second metal layer having a predetermined pattern connected to the first metal layer through a hot contact point formed in an insulation layer, the target further comprising an integrally-formed thermocouple temperature sensor within the first and second metal layers; and generating an X-ray by irradiating said energy beam on the target while controlling a convergence degree of said energy beam on the target by use of a convergence lens, based on a signal detected by said detecting the temperature.

* * * * *

UNITED STATES PATENT AND TRADEMARK OFFICE

CERTIFICATE OF CORRECTION

PATENT NO. : 6,456,690 B2
DATED : September 24, 2002
INVENTOR(S) : K. Yamada et al.

It is certified that error appears in the above-identified patent and that said Letters Patent is hereby corrected as shown below:

Column 8,
Line 62, after "comprising" delete ",".

Signed and Sealed this

Fifteenth Day of July, 2003

JAMES E. ROGAN
*Director of the United States Patent and Trademark Office*